United States Patent [19]

Benson et al.

[11] Patent Number: 4,835,443

[45] Date of Patent: May 30, 1989

[54] HIGH VOLTAGE HARD GLASS HALOGEN CAPSULE

[75] Inventors: Timothy A. Benson, Winchester; Peter R. Gagnon, Georgetown, both of Mass.

[73] Assignee: GTE Products Corporation, Danvers, Mass.

[21] Appl. No.: 238,967

[22] Filed: Aug. 24, 1988

Related U.S. Application Data

[63] Continuation of Ser. No. 942,327, Dec. 16, 1986, abandoned.

[51] Int. Cl.[4] ..... H01K 1/18

[52] U.S. Cl. ..... 313/579; 313/315

[58] Field of Search ..... 313/578, 580, 579, 315, 313/344

[56] References Cited

U.S. PATENT DOCUMENTS

| | | | |
|---|---|---|---|
| 3,891,885 | 6/1975 | Wurster | 313/273 X |
| 3,930,177 | 12/1975 | Martin | 313/344 X |
| 4,316,116 | 2/1982 | Graves et al. | 313/326 X |
| 4,499,401 | 2/1985 | Graves et al. | 313/315 |
| 4,598,225 | 7/1986 | Gagnon | 313/579 X |
| 4,683,397 | 7/1987 | Johnson, Jr. | 313/344 |
| 4,686,412 | 8/1987 | Johnson, Jr. | 313/344 |
| 4,743,803 | 5/1988 | Lanese et al. | 313/579 |

*Primary Examiner*—David K. Moore
*Assistant Examiner*—Sandra L. O'Shea
*Attorney, Agent, or Firm*—Joseph S. Romanow

[57] ABSTRACT

A high-voltage, low-wattage incandescent lamp having a tubular hard-glass envelope enclosing a coiled coil filament axially mounted with at least one, preferably two, intermediate filamentary supports. The lead-in wires and filamentary supports are mounted in the press seal of the lamp. Each end of the filament is mounted on an internal termination of a lead-in wire. The filament is mounted on the intermediate support(s) at point(s) along the filament body such that the body is divided into approximately equal segments or such that the operating temperature along the body is approximately uniform. Because of reduced filament sag, the tubular glass envelope has a reduced inner diameter and thinner wall thickness whereby the lamp may be more safely contained within an outer envelope in the unlikely event of a lamp burst. A lamp in accordance with the invention will exhibit enhanced operating characteristics and is well suited for applications in Europe.

10 Claims, 1 Drawing Sheet

HIGH VOLTAGE HARD GLASS HALOGEN CAPSULE

This is a continuation of co-pending application Ser. No. 942,327, filed on Dec. 16, 1986, now abandoned.

FIELD OF THE INVENTION

The present invention is directed to a unique light source capsule having supports at each end of a coiled coil incandescent filament and at least one, preferably at least two, intermediate filament supports therein. Lamps with this capsule have improved operating characteristics, and reduced hazard of containment failure.

Such light source capsules will be especially useful in a high voltage European version of Sylvania's Capsylite lamps. Both PAR and A-line versions of these lamps are commercially available in the United States.

The U.S. versions of these lamps are characterized by a low-wattage, tungsten - halogen, hard glass light-source capsule, mounted within a heavy outer envelope. See, for example, U.S. Pat. No. 4,598,225, the disclosure of which is hereby incorporated herein by reference.

BACKGROUND OF THE INVENTION

The use of parabolic aluminized reflector (PAR), elliptical reflector (ER), or reflector (R) lamps for general spot, downlighting, and/or flood lighting applications is well established. In particular, R, PAR, and ER type lamps have been accepted as the lamps of choice for short to medium distance outdoor uses, as well as for indoor display, decoration, accent, and inspection applications of down lighting.

Traditionally, incandescent PAR-type lamps, for example the PAR38, have used a filament mounted transversely in the reflector, that is, perpendicular to its axis of symmetry. Although not the best orientation for optical considerations, this was the simplest configuration to manufacture.

The optics of this configuration result in an asymmetric beam pattern and the spreading of stray light outside of the useful beam. Additionally, it was necessary to hermetically seal the outer jacket of these lamps to maintain the proper atmosphere for filament operation. This was accomplished by flame-sealing the reflector and lens.

With the introduction of PAR lamps using a halogen capsule as a light source, came lamps with axially mounted filaments yielding a more symmetric beam pattern and more efficient collection of light by the reflector into a useful beam.

Part of this gain in optical efficiency is due to the fact that the these lamps use a compact filament which more nearly approaches the theoretically ideal "point" source.

In Capsylite lamps operating at 120–130 AC; 60 Hertz such compact filaments are in part made possible by the use of a halfwave rectifying diode which reduces the effective capsule voltage from 120V to about 84V. Furthermore, with a hermetically sealed capsule, the atmosphere in the outer envelope is no longer critical, and lamps with non hermetically sealed outer jackets have become feasible.

In European line voltage PAR lamps, typically of 220 to 250V, halogen capsules have not been used because of the exceedingly long and fine filament wire that is required at this high voltage.

Low wattage (<150W), line voltage filaments tend to be long and flimsy, prone to sag and requiring multiple supports which reduce efficiency. Voltage reducing diodes cannot practically be used because they produce objectionable flickering of the filament when run on the 50 cycle AC which is standard in Europe.

SUMMARY OF THE INVENTION

This invention is directed to a low wattage (<150W) high voltage (>130V) halogen light source capsule, suitable for general lighting applications, but especially well suited for use in PAR type lamps.

In particular, the invention is directed to an improved capsule for low wattage, high voltage lamps, the improvement including one of more supports for a high efficiency filament mounted axially in a single ended hard glass capsule. The unique system of supports in the present capsule is sufficient to prevent significant coil vibration and sag over the useful filament life.

The elimination of significant sag is particularly important in PAR lamps because sag can cause the filament to move out of focus during life with a resulting drop in output. Coil vibration can cause an appearance of flicker as well as having a detrimental effect on lamp life.

The advantages in manufacturing the capsule of hard glass as opposed to quartz are the reduced material cost and number of parts involved. Hard glass has a lower working temperature, requiring less heating to form it, and has a higher thermal expansion coefficient allowing a seal to be made directly to the lead wires thus eliminating the need for the foil sealing ribbons used in quartz lamps.

The major disadvantages of hard glass are that it has a lower maximum temperature capability and is less resistant to thermal shock. Thermal loading of the bulb wall must be maintained below a certain limit and there can be no contact between the bulb wall hot internal parts which would cause an excessive thermal gradient. High thermal gradients and thermal shock are primary causes of catastrophic capsule fracture.

Advantageously, the preferred embodiments of the present invention have the coil centered axially in the capsule, and thus the distance from the bulb wall is maximized and heat is more evenly distributed, reducing temperatures and minimizing thermal gradients in the bulb wall.

DETAILED DESCRIPTION OF THE PREFERRED EMBODIMENTS

Figure 1:
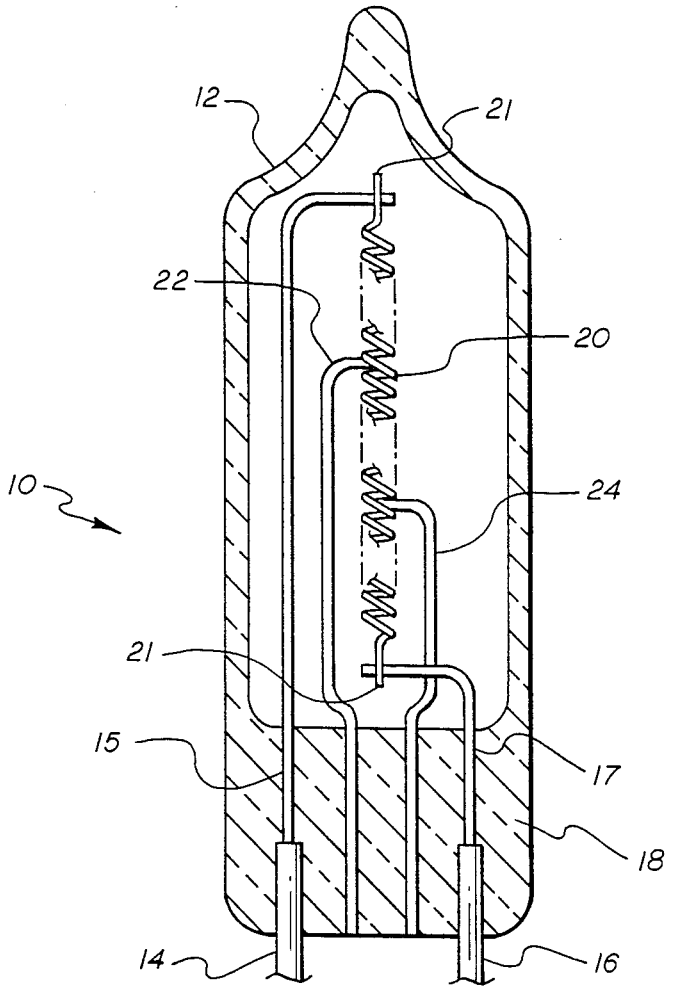
FIG. 1 is a sectional view of a lamp of the present invention.

The present invention is directed to a unique light source capsule having filamentary supports at each end of a coiled coil incandescent filament and at least one, preferably at least two, intermediate filament supports therein.

FIG. 1 represents an example of an incandescent lamp 10, in this embodiment being of the tungsten halogen variety, prepared in accordance with the teachings of the present invention.

As illustrated, lamp 10 comprises a tubular envelope 12, prepared from a light transmissive material, such as aluminosilicate glass. A pair of lead in wires 14 and 16, portions of which serve as mounting and energizing means, are press sealed in envelope 12 at press seal 18.

Lead in wires 14 and 16 can be formed from any suitable material, for example, molybdenum, which will form a relatively strain free hermetic seal with glass envelope 12. A refractory metal, such as tungsten, is used to form the coiled coil filament 20 in accordance with the teachings of this invention. Coiled coil filament 20 is provided with legs 21 at each end thereof during its formation.

In this embodiment, envelope 12 is filled with a fill gas, comprising an inert gas and a suitable halogen or halide. Preferred examples of fill gases useful herein include the inert gases; argon, krypton, xenon, and/or nitrogen; plus the halogen or halide.

As illustrated, the coil mount is preferably a single assembly consisting of the filament 20, primary lead wires 15 and 17, coil supports 22 and 24, and external lead wires 14 and 16, all rigidly attached to, and extending into the capsule from the press seal end 18.

Unlike quartz capsules which usually use a "bridge" to hold support wires, the support members of the present invention are sealed to the glass envelope within the press seal area in the same manner as the two primary leads that supply voltage to the capsule without the need for said "bridge".

Advantageously, both the leads and the supports are approximately equally spaced in the press area to insure good sealing and electrical isolation. Upon exiting the press on the interior of the capsule, the support wires preferably bend outwardly on either side of the plane of the primary leads, continuing up the length of the bulb until being fastened to the filament by clamping or other means.

The leads and supports are preferably arranged in unique directions about the filament with roughly equal angular distribution around the circumference of the capsule such that adequate spacing is provided to prevent arcing and to minimize filament shadowing in any given direction about the capsule.

Advantageously, the supports are attached to the filament at intervals so as to create approximately equal length sections of filament. Coil sag is thus minimized over a number of small independent segments, extending life and maintaining proper position of the filament for focus.

Preferably, the spacing can be varied to achieve a more uniform temperature distribution in the filament and thus extend life. Normally, a coil simply supported at the ends has a thermal distribution such that the center turns run hotter than the end turns. By clamping the supports closer to the middle of the filament and making the middle secton shorter relative to the end sections, the heat sinking effect of the supports will cause the maximum temperature of the middle section to decrease and the maximum temperature of the ends to increase.

By thus lowering the peak temperature and raising the temperature of the cooler ends an equivalent amount of light can be produced at a lower maximum temperature overall. Since the maximum coil temperature is a major determining factor of lamp life, lowering the maximum temperature will result in longer life. The supports are attached between the turns of the filament such that the filament is constrained from moving both radially to prevent sag and axially to prevent filament "stretch" and compression which are detrimental to lamp life.

In the most preferred embodiments, the support wires are of relatively small diameter to minimize heat conduction from the filament and shadowing. Yet, the supports are rigid enough to resist shock and vibration and remain stationary in the bulb. This preferred diameter ranges from about 0.004"]to 0.012".

Unlike many double ended quartz lamp designs the supports are not in contact with the bulb wall, to avoid high thermal gradients in the glass and help minimize thermal conditions from the filament which can reduce lamp efficiency.

The preferred capsule design of the present invention offers two important improvements in containment of the lamp should the capsule fail violently and rupture at high pressure.

First, a capsule of reduced volume is made possible because the compact coil design allows the capsule to be made shorter and the axially mounted filament allows the capsule to be of smaller diameter than with a transverse or "folded" filament. The smaller volume capsule will contain less gas with a lower amount of total energy for a given pressure and will fracture with less violence since there is less energy to dissipate.

A second important but unobvious advantage gained by decreasing the diameter is a reduction in the wall thickness of the capsule. The amount of stress in the glass of the capsule is directly proportional to its diameter and inversely proportional to the wall thickness. Therefore, if the diameter is reduced, the wall thickness can be reduced proportionately while maintaining constant stress for a given pressure. Reducing the wall thickness will reduce the amount of glass that would be fractured by a violent failure and decrease the size and mass of the individual projected fragments. These fragments of reduced size and mass are far less likely to cause a containment failure of the outer envelope.

For example, for a typical lamp (Philips Type 12119W/100W 220–230V) of folded filament design, the filament has a maximum width of about 0.21".

A certain minimum spacing must be maintained between the filament and the bulb wall to insure that the glass does not overheat. In the case of the folded filament design, the heat is locally concentrated, and the spacing must be large, around 0.190" minimum inner diameter. With a 0.035" thick bulb wall, this capsule will have a stress of 1240 psi at a pressure of 10 atmospheres.

For an axially mounted filament of equivalent wattage, the i.d. of the capsule can conservatively be reduced to 0.422". At this diameter, the wall thickness can be decreased to 0.025" while maintaining stress at 1240 psi for a pressure of 10 atmospheres.

These changes in diameter and wall thickness yield a decrease in both capsule volume and total mass of glass of more than 50%. These two elements combine to give this capsule improved likelihood of containment over current designs. This is an especially important consideration in an A-Line lamp application where soft glass outer jackets of relatively small glass thickness are most often used.

Improved containment characteristics will allow a lower cost outer jacket to be used and the reduced capsule volume and glass thickness lead to savings in material costs for glass and fill gas. Additionally, the smaller capsule size will help maintain adequate temperatures to allow the halogen cycle to operate in high voltage capsules at reduced wattages.

With the unique system of filament supports, the use of a low wattage, high voltage filament with a high degree of compacting becomes possible without excessive sag. This shorter coil can then be radially centered to yield a more optically efficient capsule to be utilized in a reflector.

Improved containment characteristics are also obtained as a result of the smaller capsule made possible by the compact axial filament. This capsule can be made in hard glass, with a large savings in cost. Using a capsule as a light source eliminates the need to hermetically seal the outer envelope and thus bonded beam lamps are possible.

EXAMPLE

As illustrated in FIG. 1, the most preferred capsule of the present invention is similar to the Sylvania Capsylite PAR38 capsule, but includes the novel filament coil supports of the present invention.

In the most preferred embodiment, the compact coiled coil filament used is a coiled coil of refractory metal wire having a diameter d, wherein the primary winding diameter $D_1$ and the secondary winding diameter $D_2$ of said filament are defined by the equations:

$$D_1=d(A+2)$$

and $$D_2=D_1(B+2)$$

wherein:

$$1.40 \leqq A \leqq 4.00;$$

and $$A \leqq B \leqq 4.0;$$

wherein the coiled coil filament requires at least one intermediate support, and the distance between the mounted end of said filament and said support, SL, satisfies the equation:

$$\tfrac{1}{2} \leqq SL \leqq 20D_2.$$

Filaments of this type are described in a copending application entitled "Compact Coiled Coil Filament" (Pierce Johnson, Jr.) Ser. No. 942,339, filed on even date herewith.

What is claimed is:

1. An incandescent lamp comprising:

(a) an elongated light-transmissive hard-glass envelope hermetically enclosing an interior, said envelope including a tubular body about a longitudinal axis and a press seal at one end thereof;

(b) two electrical lead-in wires protruding into said interior and having an internal termination within said interior; each of said lead-in wires having a segment thereof imbedded in said press seal;

(c) a coiled coil incandescent filament mounted along said longitudinal axis, said filament having a body and two opposed ends, each of said filamentary ends being mounted and electrically connected, respectively, on an internal termination of one of said lead-in wires;

(d) at least one intermediate filamentary support, said support being imbedded in said press seal and extending into said interior, said filament being mounted on said support at a point on said body of said filament intermediate said filamentary ends, said support being electrically isolated from both of said lead-in wires; and (e) said lamp having a rated wattage of less than one hundred and fifty watts and a rated operating voltage of greater than one hundred and thirty volts.

2. A lamp as described in claim 1 wherein said lamp includes first and second filamentary supports, said filament being mounted on said first support at a second point on said body of said filament intermediate said filamentary ends.

3. A lamp as described in claim 2 wherein said first and second points on said filament body are spaced such that said body of said filament is divided into three segments of approximately equal length.

4. A lamp as described in claim 2 wherein said first and second points on said filament body are spaced such that the operating temperature distribution along said body of said filament is optimum in the sense that said operating temperature distribution along said body of said filament is as nearly uniform as possible.

5. A lamp as described in claim 2 wherein said lead-in wires and said filamentary supports are mounted in said press seal such that said filamentary supports are approximately equally spaced between said lead-in wires.

6. A lamp as described in claim 2 having a reference plane defined as including said longitudinal axis and being parallel to said press seal wherein, within said interior of said capsule, said lead-in wires lie substantially within said reference plane, said first filamentary support is positioned substantially apart from said reference plane on one side thereof, and said second filamentary support is positioned substantially apart from said reference plane on the other side thereof.

7. A lamp as described in claim 1 wherein said tubular body of said envelope has a wall thickness of approximately 0.025 inches or less.

8. A lamp as described in claim 1 wherein said tubular body of said envelope has an inside diameter of approximately 0.422 inches or less.

9. A lamp as described in claim 1 wherein said lamp is a tungsten-halogen lamp.

10. A lamp as described in claim 1 wherein each of said lead-in wires includes a segment of molybdenum wire within said press seal.

* * * * *